United States Patent [19]

Marshall et al.

[11] 3,955,742

[45] May 11, 1976

[54] CONTAINER LID WITH INTEGRAL REMOVABLE EATING UTENSIL

[76] Inventors: Paul W. Marshall, 3507 E. 21st; Darrell F. Beaver, 5012 S. 68 East Ave., both of Tulsa, Okla. 74145; Lawrence M. Thomas, 211 S. 117 East Place, Tulsa, Okla. 74128

[22] Filed: Feb. 24, 1975

[21] Appl. No.: 552,237

[52] U.S. Cl. ..... 229/1.5 C; 220/270; 220/307

[51] Int. Cl.[2] ..... B65D 3/00

[58] Field of Search ..... 229/1.5 C; 220/270, 220/306, 307

[56] References Cited

UNITED STATES PATENTS

| | | | |
|---|---|---|---|
| 1,625,335 | 4/1927 | Schneider | 229/1.5 C |
| 1,657,325 | 1/1928 | Suttle | 229/1.5 C |
| 1,749,658 | 3/1930 | Ault | 229/1.5 C |
| 2,598,987 | 6/1952 | Franzen | 229/1.5 C |
| 3,381,876 | 5/1968 | Biggins | 229/1.5 C |
| 3,572,579 | 3/1971 | Mueller | 220/270 |
| 3,773,207 | 11/1973 | Dokoupil et al. | 220/270 |
| 3,779,416 | 12/1973 | Wilcox | 220/270 |

FOREIGN PATENTS OR APPLICATIONS

| | | | |
|---|---|---|---|
| 541,225 | 11/1941 | United Kingdom | 229/1.5 C |
| 326,788 | 3/1930 | United Kingdom | 229/1.5 C |

*Primary Examiner*—Leonard Summer
*Assistant Examiner*—Joseph M. Moy
*Attorney, Agent, or Firm*—Head, Johnson & Chafin

[57] ABSTRACT

A container for edible material including an upright open top vessel having a circumferential upper lip and a lid of generally flat, thin, impervious material having the outer edge configured to removably sealably engage the vessel circumferential upper lip and having an eating utensil, such as a spoon or fork, outlined by a continuous notch impressed in the lid material, the notch communicating at two places with the edge of the lid so that a user may, by pulling on the edge, tearing the material from which the lid is formed along the continuous notch thereby extract out of the lid the eating utensil.

2 Claims, 6 Drawing Figures

CONTAINER LID WITH INTEGRAL REMOVABLE EATING UTENSIL

BACKGROUND, SUMMARY AND OBJECTS OF THE INVENTION

One problem with dispensing soft liquid or semi-liquid foods, such as custard, prepared fruit and so forth for immediate consumption is that the purchaser must have some sort of eating utensil. At the present time it is customary for stores, food stands and so forth, which dispense food for immediate consumption, to supply an inexpensive wood or plastic spoon as a separate item. One problem with this procedure is that many health authorities insist that the eating utensil be wrapped separately in some way so that it is not handled in an exposed condition by anyone other than the ultimate user.

Supplying a spoon, fork or other similar eating utensil as a separate item with the purchase is troublesome, expensive, and time consuming. In addition, providing an eating utensil is difficult to do when the food is dispensed from an unattended machine. The present invention is directed toward means of providing a spoon, or other eating utensil, integral with the package in which the liquid or semi-liquid food for immediate consumption is sold. Particularly, the invention is concerned with a container for dispensing ready-to-eat food in semi-liquid form having a lid which sealably closes the container, the lid including, as an integral part thereof, a spoon or other eating utensil.

It is therefore an object of this invention to provide an improved container for dispensing ready-to-eat foods.

Another object of this invention is to provide a lid for a container for use in dispensing food, the lid including as an integral part thereof, a removable eating utensil.

Still more particularly, an object of this invention is to provide a container including a lid, the lid having formed therewith, an eating utensil defined by a continuous groove or notch which circumscribes the eating utensil which retains the lid in a completely sealed condition until the eating utensil is removed by grasping at one edge of the lid and pulling upwardly on the eating utensil so that it is torn from the lid along the continuous notch or groove.

These general objects, as well as other and specific objects of the invention, will be fulfilled in the following description and claims, taken in conjunction with the attached drawings.

DESCRIPTION OF THE VIEWS

DETAILED DESCRIPTION

Figure 1:
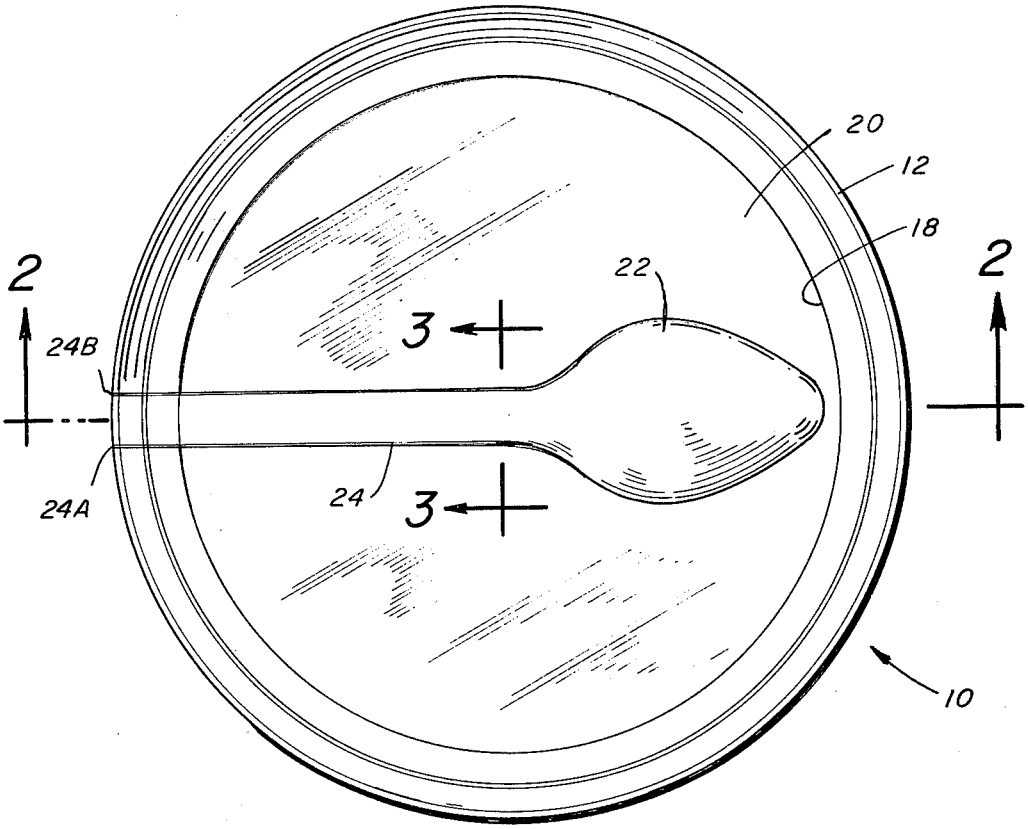
FIG. 1 is a top view of a lid embodying an integral eating utensil, in this instance, a spoon.
Figure 2:
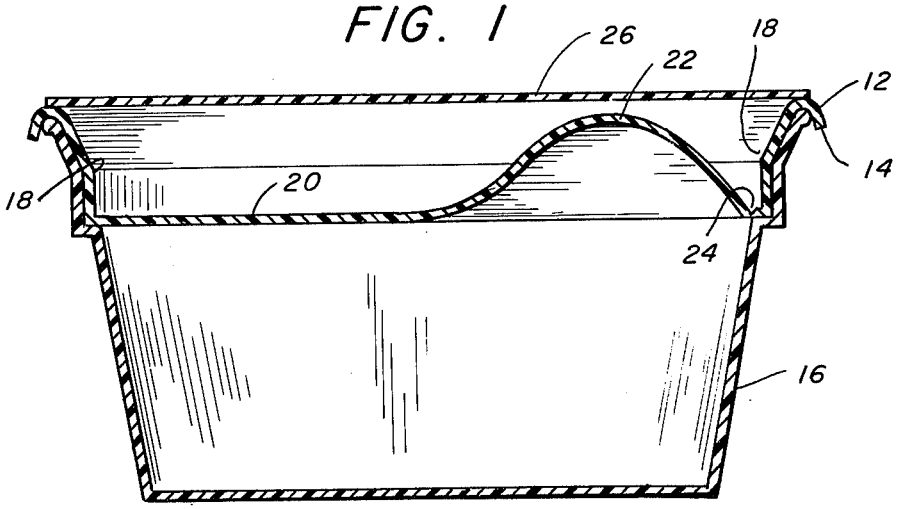
FIG. 2 is a cross-sectional view taken along the line 2—2 of FIG. 1 showing the lid as utilized on a container.
Figure 3:
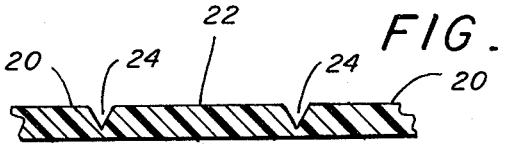
FIG. 3 is an enlarged cross-sectional view taken along the lines 3—3 of FIG. 1 and showing the notch to either side of the removable spoon.

Referring to the drawings and first to FIGS. 1 and 2, an embodiment of the invention is shown. The lid is generally indicated by the numeral 10. The lid is formed of molded thin imprevious material, such as plastic. The lid 10 in FIG. 1 is shown to be circular although in practice of the invention the lid may be arranged to fit a square or other shaped container. The lid 10 has an outer peripheral surface 12 which is curved to fit over the upper edge 14 of an open top container 16.

The lid as shown in FIGS. 1 and 2 includes a circumferential upwardly extending portion 18 and a central, generally flat portion 20. The upperly extending portion 18 is utilized to conform to the upper portion of the container 16 to more effectively seal the container. The specific structural arrangement of the container and the upwardly extending portion 16 of the lid to seal the container is not a part of this invention since containers of this type having a wide variety of designs are readily available on the market.

Figure 5:
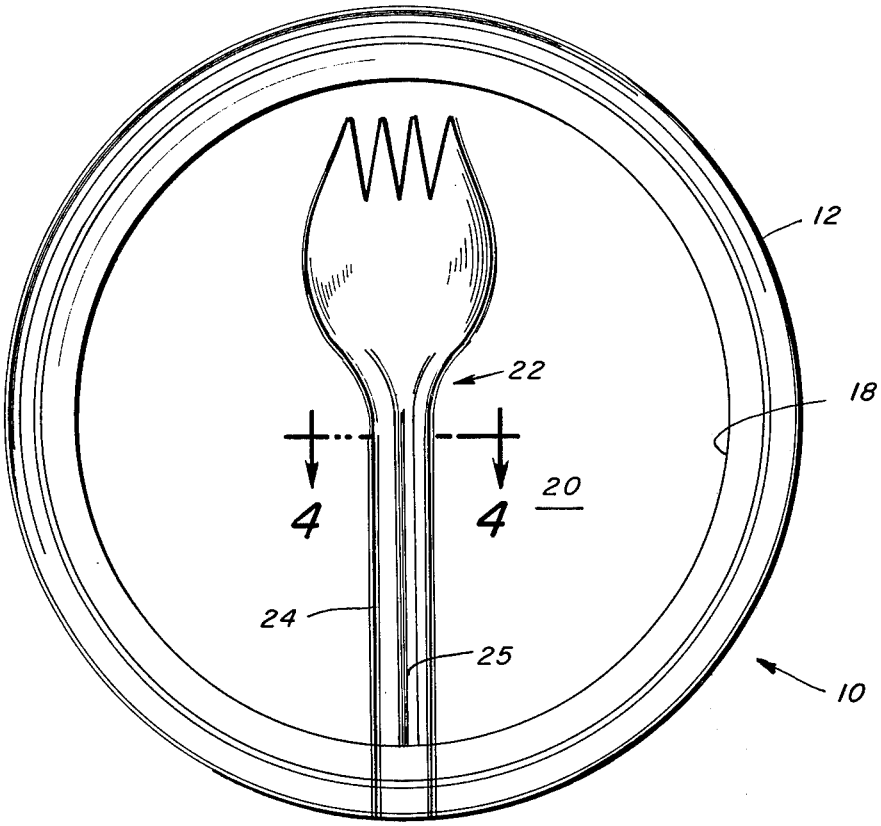
FIG. 5 is a view as shown in FIG. 1 but showing the arrangement wherein the eating utensil is in the shape of a fork.

Formed integrally with the lid, and primarily in the central flat portion 20 thereof, is an eating utensil 22 which, in FIG. 1 is in the form of a spoon whereas, as an indication of the variety of shapes the eating utensil may have, is shown in FIG. 5 as a fork. The eating utensil 16 is integral in all respects with the lid 10 and forms a part of the lid. The eating utensil 22 is defined by a continuous groove or notch 24. The notch 24 begins at one point 24A on the lid outer edge 12 and continues around the total outline of the integral eating utensil 22 to terminate at a point 24B on the lid outer edge. The points 24A and 24B are spaced apart from each other.

To remove the spoon 22 the user grasps the portion of the edge of the lid between points 24A and 24B. By pulling upwardly on this portion the spoon is torn out of the lid by the provision of notch 24. After the spoon is removed from the lid the lid remaining can easily be removed from the container 16. As an alternative, the lid may be removed from the container before the utensil is extracted from the lid. Either way the user has the extracted spoon 22 with which to eat the contents of the container.

It can be seen that the provision of the spoon 22 requires only a very slight additional amount of material in formulation of the lid. This additional material is only that required to form the bowl portion of the spoon. Thus, with a very slight additional amount of material the lid is configured to provide the integral eating utensil which is always packaged with the container and readily available for use.

Figure 4:
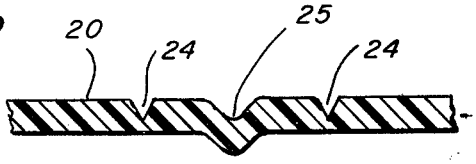
FIG. 4 is a cross-sectional view taken along the line 4—4 of FIG. 5 showing an alternate arrangement for adding increased rigidity to the utensil handle.

Whereas, in the drawings the handle portion of the spoon is shown to be flat, it can be seen that if desired to add rigidity an integral deep groove 25 can be formed in the spoon handle portion such as shown in FIGS. 4 and 5.

In order to completely protect the eating utensil formed integrally with the lid 10, an impervious membrane 26 of thin plastic material may be stretched over and sealed against the lid edge 12. This may be done by heat sealing or otherwise. The thin plastic membrane 26 can be transparent to readily reveal the integral spoon beneath it. The user would then merely puncture the thin membrane 26, tear it off and then remove the spoon as previously described.

Figure 6:
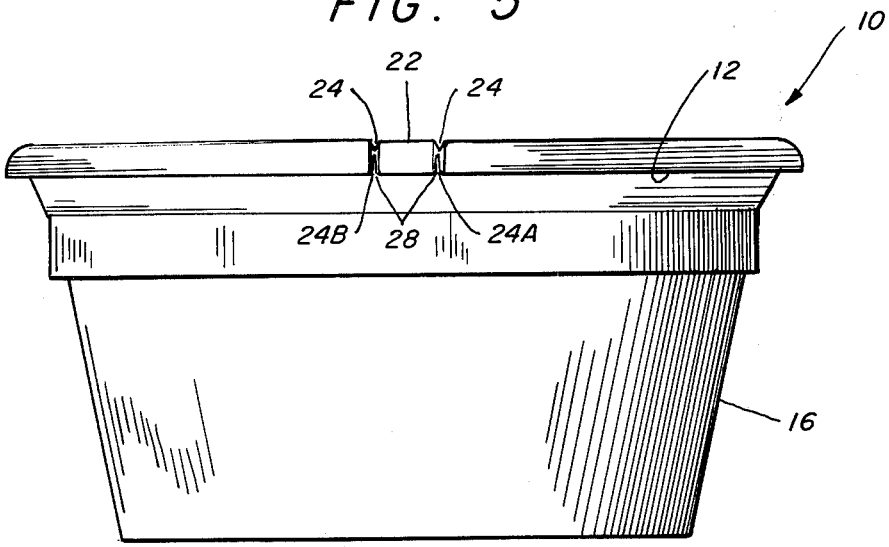
FIG. 6 is an elevational view of the container of FIGS. 1 and 2 showing the area wherein the utensil is grasped to remove it from the lid.

FIG. 6 shows a side view. Here the notch 24 is cut clear through the material of lid 10 at the edge 12, the through cut notch being indicated by numeral 28. These complete cutouts 28 extend for short distances at the beginning of the groove 24 at points 24A and 24B and facilitate the removal of the spoons since they provide tear points. When the user grasps the area between 24A and 24B and lifts it upwardly the eating utensil is more easily torn from the lid.

While the invention has been described with a certain degree of particularity it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A container for edible material, comprising:

an upright open top vessel having a circumferential upper lip;

a lid of thin, imprevious material having an outer edge shaped to removably sealably engage the circumferential upper lip of said container when pressed thereagainst, the outer edge of the lid sealably fitting the upper internal circumferential top portion of said vessel and the lid having a circumferential portion conforming to said circumferential upper lip of said vessel and the edge of the lid extending down over and externally of said vessel circumferential upper lip, the lid having an integrally formed eating utensil, the utensil being outlined by a notch of reduced thickness of the lid material, the notch beginning at a first point on the edge of the lid, the notch extending around the total perimeter of the defined utensil and terminating at a second point on the edge of the lid spaced from said first point, the notch adjacent the first and second points on the external circumferential downwardly extending lid edge being cut through the lid material for a short distance from the lid edge, the portion of the downwardly extending edge of the lid between said first and second points providing a finger grip area externally of said vessel circumferential upper lip whereby the portion of the lid may be pulled upwardly, tearing the lid along the notch beginning with the cut through portions so that the defined utensil may be detached from the remainder of the lid.

2. A container according to claim 1 including:

a thin, flexible membrane sealably secured to the upper surface of the lid upwardly extending circumferential portion, the membrane sealably closing the upper surface of the lower portion of the lid having the integral utensil defined therein.

* * * * *